US009244399B2

(12) United States Patent
Konno

(10) Patent No.: US 9,244,399 B2
(45) Date of Patent: Jan. 26, 2016

(54) IMAGE-FORMING APPARATUS

(71) Applicant: CANON KABUSHIKI KAISHA, Tokyo (JP)

(72) Inventor: Yuya Konno, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/467,276

(22) Filed: Aug. 25, 2014

(65) Prior Publication Data

US 2015/0071666 A1 Mar. 12, 2015

(30) Foreign Application Priority Data

Sep. 10, 2013 (JP) ..... 2013-187461

(51) Int. Cl.

*G03G 15/00* (2006.01)
*G03G 15/20* (2006.01)
*G03G 13/20* (2006.01)

(52) U.S. Cl.

CPC ..... *G03G 15/2039* (2013.01); *G03G 13/20* (2013.01)

(58) Field of Classification Search

CPC ... G03G 15/2039; G03G 15/50; G03G 15/55; G03G 15/80; G03G 15/205; G03G 15/2028; G03G 13/20

USPC ..... 399/67, 68, 82, 88, 320, 322, 337

See application file for complete search history.

(56) References Cited

U.S. PATENT DOCUMENTS

| | | | |
|---|---|---|---|
| 7,751,742 | B2 | 7/2010 | Matsudaira et al. |
| 2008/0075497 | A1 | 3/2008 | Matsudaira et al. |
| 2009/0052955 | A1 * | 2/2009 | Tatematsu et al. ..... 399/329 |

FOREIGN PATENT DOCUMENTS

| | | | |
|---|---|---|---|
| JP | 2004-294855 | A | 10/2004 |
| JP | 2005-345663 | A | 12/2005 |
| JP | 2008-076925 | A | 4/2008 |
| JP | 2008-292988 | A | 12/2008 |
| JP | 2012-141404 | A | 7/2012 |

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image-forming apparatus is provided which enables more productive image formation. When an option unit implements a change from a second operation mode that exhibits high power consumption to a first operation mode that exhibits low power consumption while images are being consecutively formed on a plurality of recording materials, an upper limit on power that can be supplied to a fixing section is set higher than that in the second operation mode, and intervals, at which recording materials are consecutively fed, are set narrower than those in the second operation mode.

11 Claims, 9 Drawing Sheets

IMAGE-FORMING APPARATUS

BACKGROUND OF THE INVENTION

1. Field of the Invention

The present invention relates to an image-forming apparatus such as an electrophotographic printer.

2. Description of the Related Art

In many image-forming apparatuses to which an option unit, such as a sheet discharging unit, can be connected, a power supply plug of the option unit is connected to the image-forming apparatus so that the image-forming apparatus can supply power to the option unit. In such an apparatus form, the total current consumed by the image-forming apparatus and the option unit needs to be equal to or smaller than the rated current consumption of a commercial power supply, 15 A.

Some option units operate in a plurality of operation modes with different current consumptions. An image-forming apparatus using an electrophotographic technique has a fixing section that heats and fixes toner to a recording material. Thus, when the option unit operates in an operation mode with a large current consumption, the maximum value of the amount of current consumed by the fixing section needs to be limited compared to when the option unit operates in an operation mode with a small current consumption. For example, power consumption may be reduced by controllably turning off the fixing section while the option unit is in operation (Japanese Patent Application Laid-open No. 2004-294855). Furthermore, when the option unit operates in an operation mode with a large current consumption, sheets may be conveyed at wider sheet intervals than those in an operation mode with a small current consumption in order to gain a longer time to recover the temperature of the fixing section.

The image-forming apparatus may consecutively form images on a plurality of sheets, and during such an operation, the operation modes of the option unit may be switched over. For example, when the operation mode is switched from a mode with a large current consumption to a mode with a small current consumption, it is inefficient to continue image formation at increased sheet intervals.

SUMMARY OF THE INVENTION

An object of the present invention is to provide an image-forming apparatus that enables more productive image formation.

Another object of the present invention is to provide an image-forming apparatus comprising:

a fixing section that fixes an image formed on a recording material to the recording material;

a timing setting section that sets a timing at which the recording material is fed;

an operation mode acquiring section that acquires an operation mode of an option unit installed in the image-forming apparatus; and a power control section that sets upper limit power that can be supplied to the fixing section in accordance with the operation mode acquired by the acquiring section, the power control section controlling power supplied to the fixing section within a range of the upper limit power, wherein, when the operation mode acquired by the operation mode acquiring section changes from a second operation mode in which the option unit consumes a large amount of current to a first operation mode in which the option unit consumes a small amount of current, while images are being consecutively formed on a plurality of recording materials, the power control section increases the upper limit power higher than that in the second operation mode, and the timing setting section sets a feeding interval, at which recording materials are consecutively fed, narrower than that in the second operation mode.

Further features of the present invention will become apparent from the following description of exemplary embodiments (with reference to the attached drawings).

DESCRIPTION OF THE EMBODIMENTS

Now, with reference to the drawings, the implementation of the present invention will be described below in detail in an illustrative manner based on embodiments. However, the sizes, materials, shapes, relative arrangements, and the like of components described in the embodiments should be appropriately changed in accordance with the configuration of an apparatus to which the invention is applied or with any of various conditions. That is, the scope of the invention is not intended to be limited to the following embodiments.

Embodiment 1

Configuration of the Image-Forming Apparatus

Figure 1:
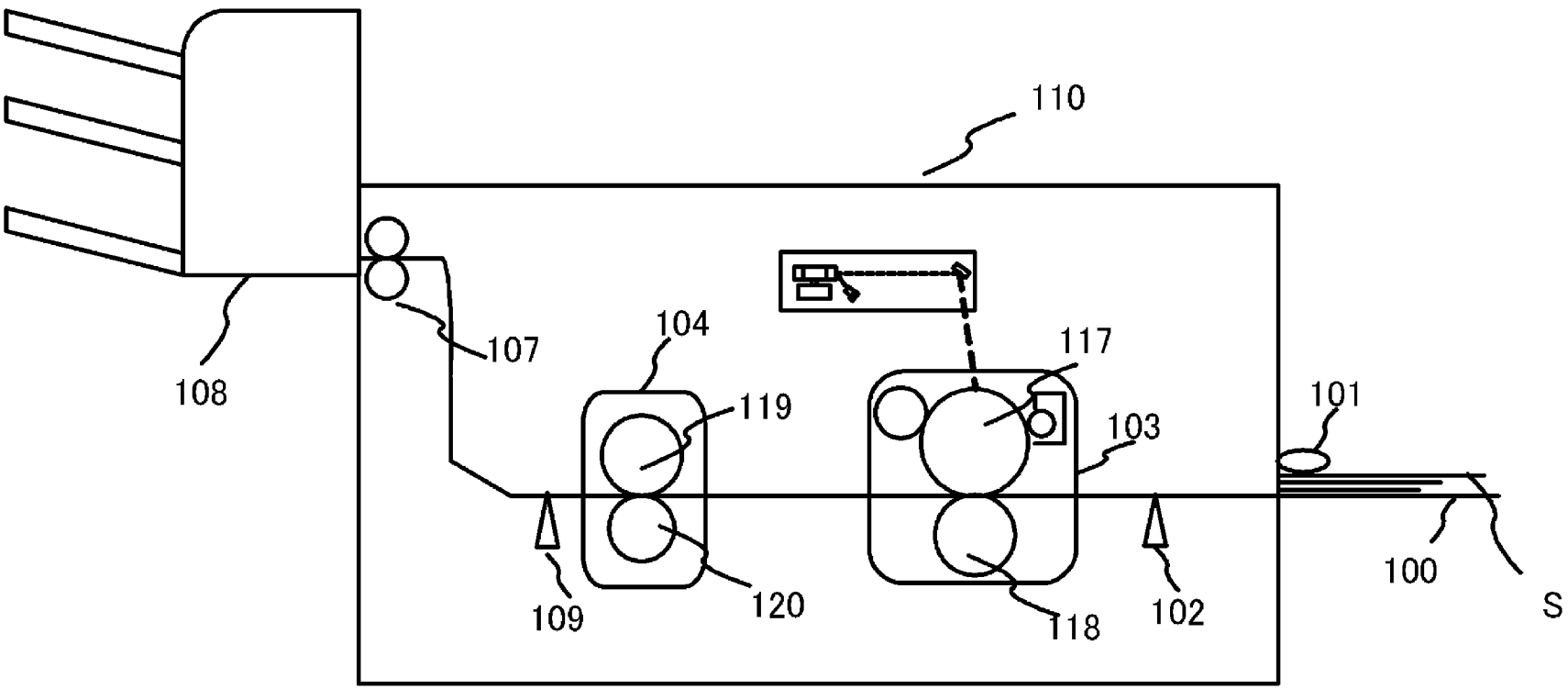
FIG. 1 is a cross-sectional view of a general configuration of an image-forming apparatus.

FIG. 1 is a schematic cross-sectional view showing a general configuration of an image-forming apparatus according to an embodiment of the present invention.

Upon receiving a print instruction, an image-forming apparatus 110 rotationally moves a sheet feeding roller 101 to feed a sheet S serving as a recording material from a sheet feeding tray 100. When the sheet S reaches a sensor 102 arranged on a conveying path, the image-forming apparatus 110 detects that a leading end of the sheet S has reached the position of the sensor 102. The sensor 102 remains in a sheet present state until a trailing end of the sheet S passes through the sensor 102. When the trailing end of the sheet S passes through the sensor 102, the image-forming apparatus 110 detects the trailing end of the sheet S. In consecutive printing (consecutive image formation), the image-forming apparatus 110 performs control allowing a sheet interval (recording material feeding interval) to be kept at a desired value by feeding a new sheet when a predetermined time has elapsed since the detection of the leading or trailing end of the preceding sheet.

Subsequently, the sheet S reaches an image-forming section 103. In the image-forming apparatus 110 according to Embodiment 1, the image-forming section 103 forms a toner image on the sheet S using what is called an electrophotographic system. That is, first, a surface of a drum roller (photosensitive member) 117 rotating clockwise in the figures and serving as an image bearing member is uniformly charged by charging means such as a charging roller. Then, exposure means such as a laser scanner irradiates the surface of the drum roller 117 with laser light modulated in accordance with image data to remove the charge from the portion of the drum roller 117 irradiated with laser light. Thus, an electrostatic latent image is formed on the surface of the drum roller 117. Subsequently, a developing device develops the electrostatic latent image with toner to form (develop) a toner image on the surface of the drum roller 117. Then, with the sheet S sandwiched between the drum roller 117 and a transfer roller 118, the toner image on the drum roller 117 is transferred to the sheet S. Subsequently, the sheet S with the toner image transferred thereto is conveyed to the fixing section 104. Subsequently, a fixing roller 119 and a pressing roller 120 in the fixing section 104 convey the sheet S with the sheet S sandwiched between the fixing roller 119 and the pressing roller 120. In the meantime, the sheet S is subjected to heat and pressure to fix the toner image to the sheet S. The sheet with the fixing process executed thereon is conveyed to a sheet discharging roller 107.

Like the sensor 102, the sheet discharging sensor 109 detects the leading end and trailing end of the sheet on the conveying path. The image-forming apparatus 110 determines whether or not any sheet is present in the fixing section 104 by the sheet discharging sensor 109. The sheet S is conveyed to a sheet discharging option apparatus (option unit) 108 by the sheet discharging roller 107. The image-forming apparatus 110 indicates an operation mode to the sheet discharging option apparatus 108 that is an option unit in accordance with an instruction from a controller (not shown in the drawings). The sheet discharging option apparatus 108 executes a normal discharge process, a sorting process, a staple process, or the like in accordance with the operation mode indication from the image-forming apparatus 110. When the sheet discharging option apparatus 108 executes a predetermined process, the image-forming apparatus 110 completes a series of printing operations.

Figure 2:
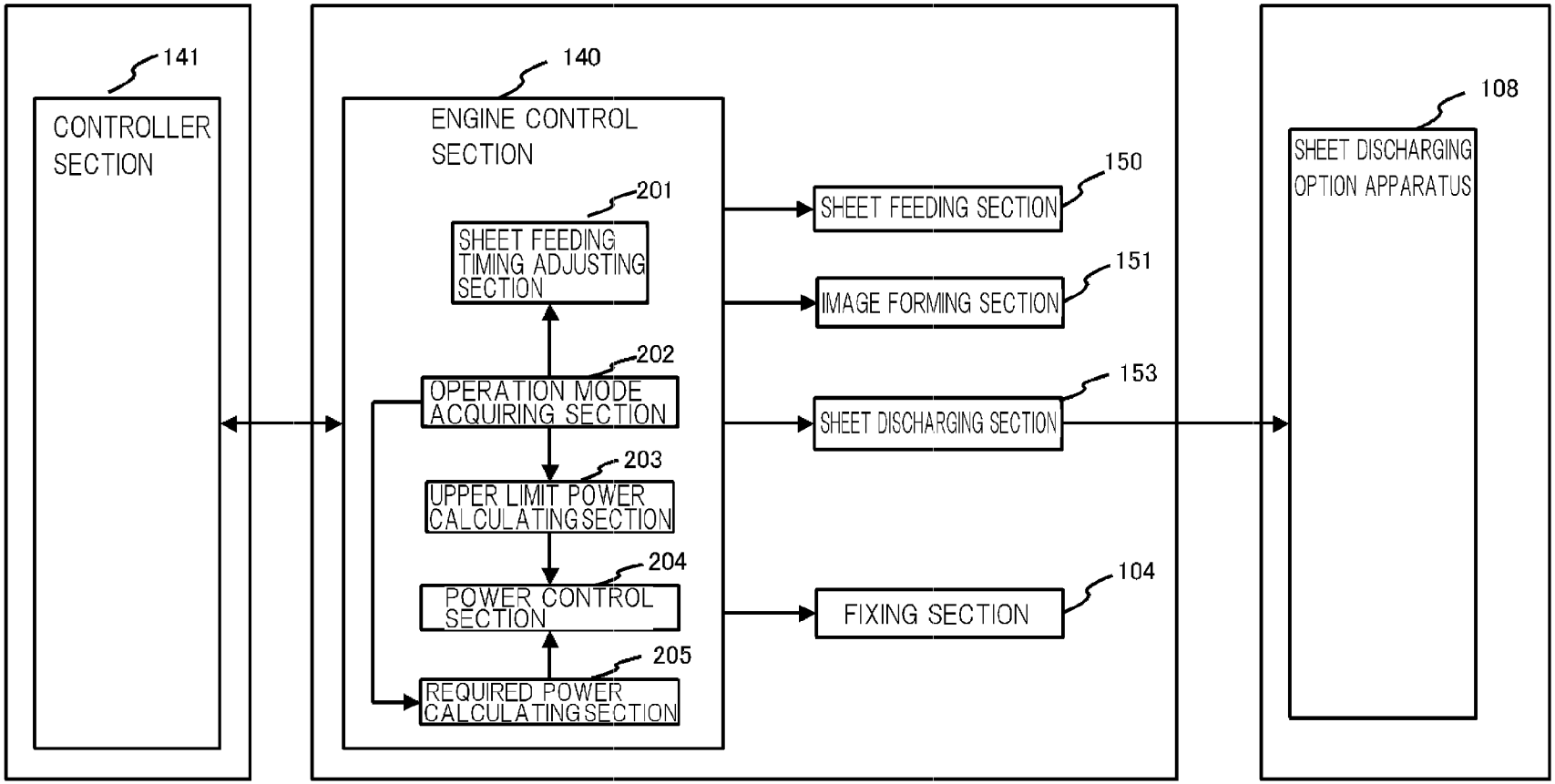
FIG. 2 is a control block diagram of the image-forming apparatus.

FIG. 2 is a block diagram showing a control configuration that controls sections of the image-forming apparatus 110 shown in FIG. 1. If images are consecutively formed on a plurality of sheets, a preceding one of two consecutive sheets is hereinafter referred to as a preceding sheet. A sheet immediately after the preceding sheet is hereinafter referred to as a succeeding sheet.

The apparatus according to Embodiment 1 is an image-forming apparatus to which an option unit that is operated when supplied with power by the image-forming apparatus is connected; the option unit executes a first operation mode and a second operation mode with a larger current consumption than the first operation mode. When the operation mode acquired by an operation mode acquiring section described below changes from the second operation mode to the first operation mode while images are being formed on a plurality of recording materials, a power control section described below increases upper limit power to the fixing section higher than the upper limit power in the second operation mode. Furthermore, a timing setting section described below sets intervals, at which recording materials are consecutively fed, narrower than those in the second operation mode.

A controller section 141 provides an engine control section 140 with a print operation indication specifying the operation mode of the sheet discharging option apparatus 108 and the like. Subsequently, the engine control section 140 instructs a sheet feeding section 150 to feed the preceding sheet. The engine control section 140 executes processing described below after the sensor 102 detects the leading end of the preceding sheet.

An acquiring section 202 that acquires the operation mode acquires the operation mode of the sheet discharging option apparatus (option unit) 108 indicated by the controller section 141. An adjusting section (timing setting section) 201 that adjusts a sheet feeding timing sets a sheet feeding timing for the succeeding sheet based on the operation mode acquired by acquiring section 202 and the indication from the controller section 141. Timer control is used to achieve control allowing a plurality of sheets to be consecutively fed at desired sheet intervals. In feeding the preceding sheet from a sheet feeding tray 100, the engine control section 140 clears a timer to zero. Subsequently, the engine control section 140 continues incrementing the timer. The engine control section 140 instructs the sheet feeding section to feed the succeeding sheet when the timer reaches a value set by the adjusting section 201. Upon receiving the indication from the engine control section 140, the sheet feeding section 150 feeds the succeeding sheet. The image-forming apparatus 110 performs the above-described control to consecutively feed a plurality of sheets at desired sheet intervals. An image forming section 151 transfers toner to the preceding sheet at a timing when the leading end of the preceding sheet reaches the drum roller 117.

A required power calculating section 205 calculates a target temperature for the fixing section based on print conditions indicated by the controller section and the operation mode acquired from the acquiring section 202. The required power calculating section 205 thus calculates power needed by the fixing section (to be exact, a heater that heats a fixing roller 119) to maintain the target temperature. An upper limit power calculating section 203 calculates the upper limit of power that can be supplied to the fixing section (to be exact, the heater that heats the fixing roller 119) 104 based on the results of the acquisition performed by the acquiring section 202. The upper limit power provided when the second operation mode is acquired is lower than the upper limit power provided when the first operation mode is acquired.

A power control section 204 that controls the power supplied to the fixing section 104 controls the power supplied to the fixing section (supplied to the heater) so that the temperature of the fixing section is maintained at a target value suitable for fixation of the toner image within the range of the upper limit power calculated by the upper limit power calculating section.

At a timing when the preceding sheet reaches the sheet discharging roller 107, a sheet discharging section 153 drives the sheet discharging roller 107 to discharge the sheet to the sheet discharging option apparatus 108. The sheet discharging section 153 indicates the operation mode to the sheet discharging option apparatus 108 based on the operation mode acquired by the acquiring section 202. Based on the indication from the sheet discharging section 153, the sheet discharging option apparatus 108 executes processing such as a normal discharge process, a sorting process, and a staple process. When the staple process is executed during consecutive printing operations, the controller section 141 indicates the normal discharge process when the staple process during the consecutive printing operations ends.

In Embodiment 1, for the operation mode of the sheet discharging option apparatus 108, the staple process (second operation mode) is assumed to involve a larger amount of current consumed by the sheet discharging option apparatus 108 than the normal discharge process (first operation mode). This is only illustrative and a combination of operation modes with different amounts of current is not limited to the staple process and the normal discharge process. Furthermore, the option unit connected to the image-forming apparatus is not limited to the sheet discharging option apparatus 108.

Additionally, in the present example, the sheet interval (the time difference between a sheet feeding timing for the preceding sheet and a sheet feeding timing for the succeeding sheet) is set to 1,050 msec for the operation mode 1 and to 1,150 msec for the operation mode 2. More specifically, the interval for the operation mode 2 is set wider than that for the operation mode 1. In addition, the upper limit of power supplied to the fixing section is set lower in the operation mode 2 than in the operation mode 1.

Moreover, when the operation mode acquired by the operation mode acquiring section changes from the second operation mode to the first operation mode while images are being consecutively formed on a plurality of recording materials, the power control section increases the upper limit power to the fixing section higher than that in the second operation mode. Furthermore, the timing setting section sets intervals, at which recording materials are consecutively fed, narrower than those in the second operation mode. In Embodiment 1, when the operation mode of the sheet discharging option apparatus 108 changes from an operation mode with a large current consumption to an operation mode with a small current consumption during consecutive printing operations, control is performed so as to increase the upper limit power than can be supplied to the fixing section. Additionally, not only the upper limit power is increased but the sheet interval is also changed to a value appropriate to the operation mode of the sheet discharging option apparatus 108. The following control is also performed when the upper limit power is increased. First, the power control section 204 lowers the target temperature for the fixing section 104. With the target temperature lowered, the power control section 204 increases the upper limit power. Subsequently, the power control section 204 recovers the lowered target temperature to the original value. Moreover, the power control section 204 increases the sheet interval so as to prevent the sheet from reaching the fixing section 104 during the control allowing a decrease in target temperature and an increase in upper limit power.

When a staple job is switched to a job other than the staple job during consecutive printing, power that can be used by the fixing section increases. However, if power required by the fixing section during the staple job is higher than the upper limit power and the power is in short supply, an increase in upper limit power may cause overshooting in the fixing section (heater). Thus, when the upper limit power is increased, the target temperature is temporarily lowered to suppress the power supplied to the fixing section 104. Subsequently, the upper limit power is increased, and thereafter, the lowered target temperature is recovered to the original value to allow the supply of the power required by the fixing section or power close to the required power. Furthermore, in connection with this control, the sheet interval is adjusted. This allows overshooting in the fixing section to be suppressed when the operation mode of the option unit is changed during consecutive printing to change power assignable to the fixing section.

Figure 3:
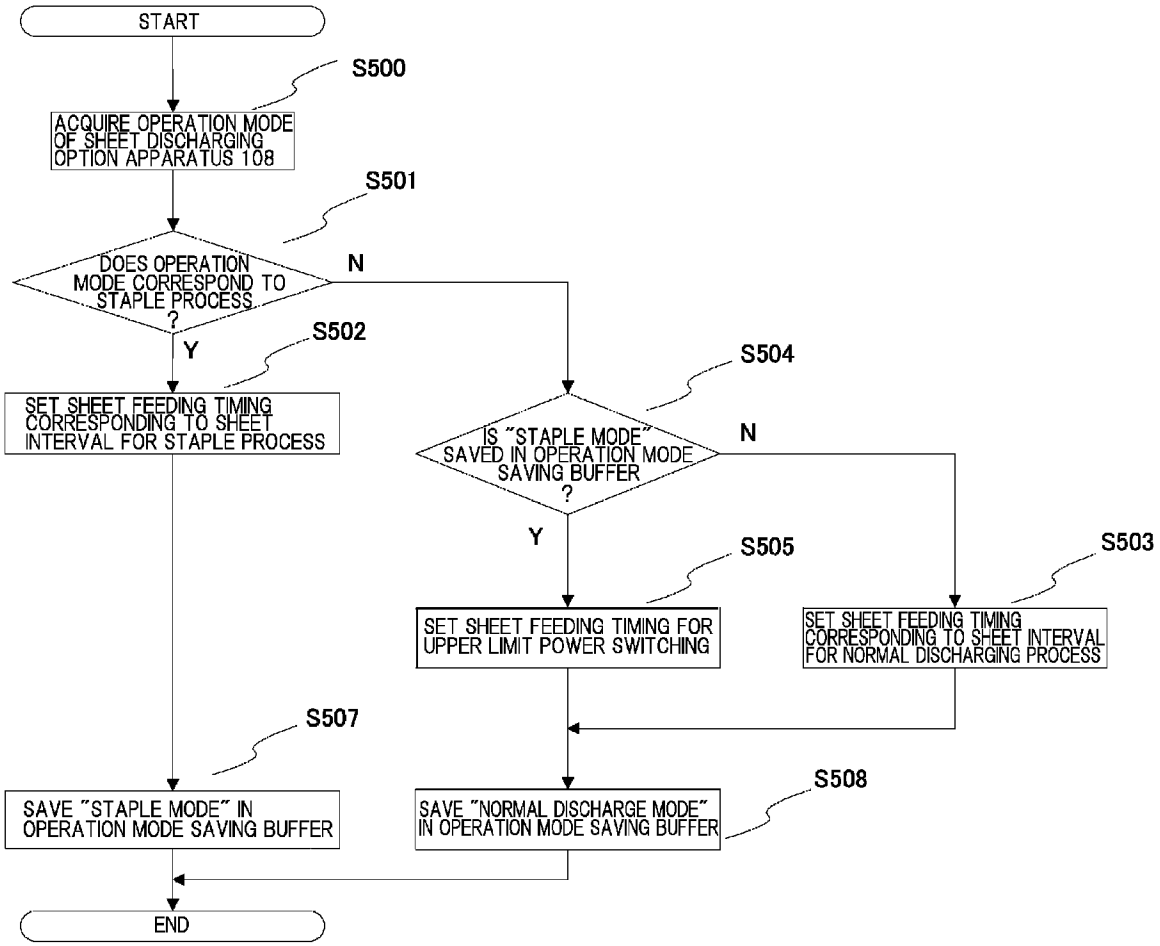
FIG. 3 is a flowchart of control allowing a sheet feeding timing for a succeeding sheet to be determined according to Embodiment 1.

FIG. 3 is a flowchart for determination of the sheet feeding timing for the succeeding sheet. The specific contents of processing executed by the sheet feeding adjusting section 201 during consecutive printing will be described below with reference to a flowchart in FIG. 6.

In S500, the operation mode of the sheet discharging option apparatus is acquired. Then, in S501, the sheet feeding adjusting section 201 determines whether or not the operation mode corresponds to the staple process. When the operation mode corresponds to the staple process, the sheet feeding adjusting section 201 sets, in S502, a timing corresponding to a sheet interval for the staple process as the sheet feeding timing for the succeeding sheet. Subsequently, in S507, the sheet feeding adjusting section 201 saves the operation mode acquired in S500 in RAM (not shown in the drawings) on the engine control section 140.

When the operation mode determined in S501 corresponds to the normal discharge process, the sheet feeding adjusting section 201 determines, in S504, whether the operation mode saved in RAM in S507 or S508 described below corresponds to the staple process or the normal discharge process. When the saved operation mode is the staple mode, the sheet feeding adjusting section 201 determines that the indication of the operation mode to the sheet discharging option apparatus 108 has been switched from the staple process to the normal discharge process and executes the processing in S505. In S505, the sheet feeding adjusting section 201 compares a sheet interval corresponding to a time Td needed by the power control section 204 for a process of increasing the supplied power with a sheet interval for normal discharge. Then, the sheet feeding adjusting section 201 sets the sheet feeding timing so that the sheet interval for the succeeding sheet is set to be equal to the wider sheet interval. When the determination in S504 indicates that the operation mode saved in RAM is the normal mode (when the determination in S504 is No), the sheet feeding adjusting section 201 determines that the sheet interval for an increase in supplied power has been achieved. Then, in S503, the sheet feeding adjusting section 201 sets a timing which is earlier than the timing set in S502 and which corresponds to a sheet interval for normal discharge. After setting the sheet feeding timing for the succeeding sheet in S505 or S503, the sheet feeding adjusting section 201 saves the normal discharge process in RAM in S508.

Furthermore, when a printing operation starts, the sheet feeding adjusting section 201 saves, in RAM, the indication of the operation mode to the sheet discharging option apparatus 108 provided at the time of start of the printing operation. Thus, in S508 with the value different from the value in S507 being saved, in S504 the sheet feeding adjusting section 201 can determine that the operation mode has been switched.

Figure 4:
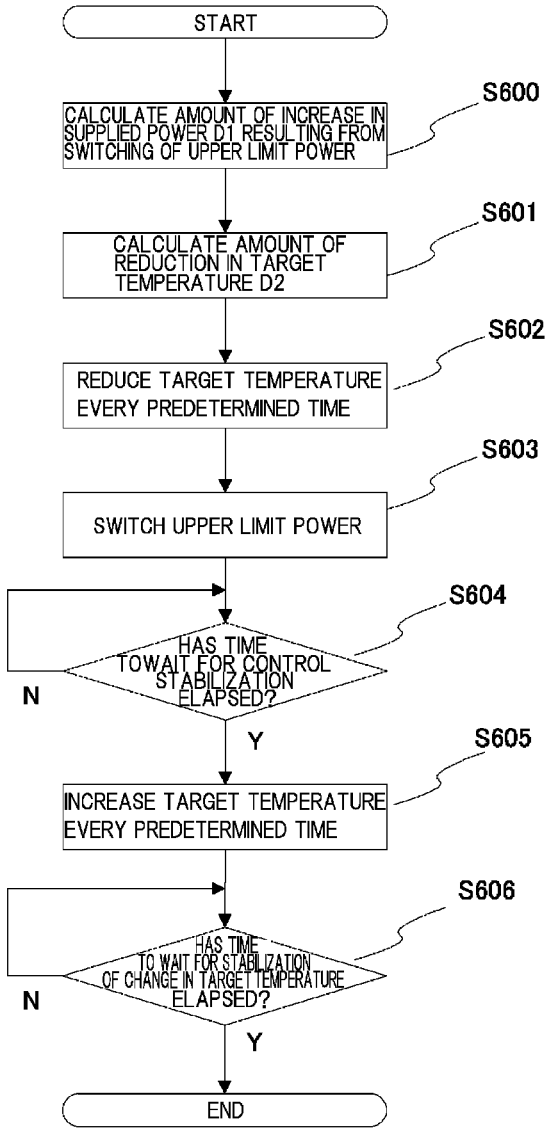
FIG. 4 is a flowchart of control of a fixing section performed to increase upper limit power according to Embodiment 1.
Figure 5:
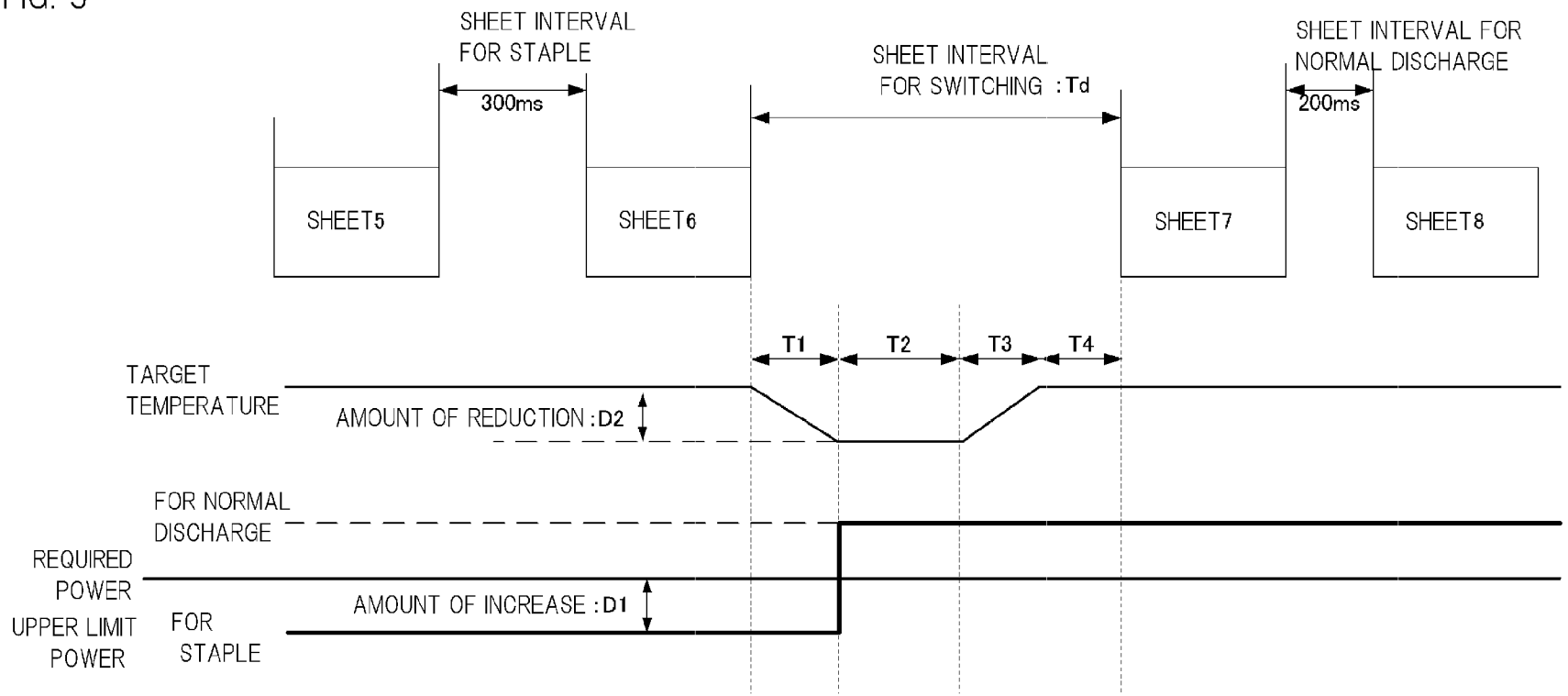
FIG. 5 is a time chart showing the control of the fixing section and a sheet interval in the control in FIG. 4.

With reference to FIG. 4 and FIG. 5, the specific contents of processing executed to increase the upper limit power will be described. FIG. 4 is a flowchart for an increase in upper limit power. FIG. 5 is a time chart showing operations performed when control in FIG. 4 is carried out.

First, the contents of FIG. 5 will be described. FIG. 5 shows that a sheet 6 is fed at a timing for staple, a sheet 7 is fed at a timing for operation mode switching, and a sheet 8 is fed at a timing for normal discharge. The target temperature starts to be lowered when the sheet 6 passes through a contact portion between the fixing roller 119 and the pressing roller 120. The target temperature is recovered to the original value before the sheet 7 reaches the contact portion between the fixing roller 119 and the pressing roller 120.

Based on this, the control in the present example will be described with reference to FIG. 4. The control in FIG. 4 is started at the timing when the sheet 6 has passed through the contact portion between the fixing roller 119 and the pressing roller 120.

In S600, the power control section 204 calculates supply power resulting from an increase in upper limit power for normal discharge on the basis of the required power acquired from the required power calculating section 205 and the upper limit power for the staple process acquired by the upper limit power calculating section 203. An increase in power is hereinafter denoted by D1. In S601, the power control section 204 calculates the amount of reduction in target temperature D2 by linearly converting the increased power D1. In S602, the power control section 204 reduces the target temperature by 1° C. every 40 msec. After the reduction in target temperature in S602 completes, the power control section 204 increases the upper limit power from the value for the staple process to the value for normal discharge in S603.

Subsequently, in S604, the power control section 204 waits 100 msec until a transient state resulting from the increase in upper limit power ends and the control is stabilized. In S605, the power control section 204 recovers the target temperature lowered in S602 to the original value by increasing the lowered target temperature by 1° C. every 40 msec. Moreover, in S606, the power control section 204 waits 100 msec until the transient state resulting from the switching of the target temperature is exited to stabilize the control. The interval Td between the sheet 6 and the sheet 7 is T1+T2+T3+T4=2×D2×40 msec+200 msec.

The amount of reduction in target temperature provided in S601 is determined based on the power required during printing acquired by the required power calculating section 205. Thus, if no sheet has undergone successful fixation since the state of the printing operation, the required power acquired in S600 is the power for normal discharge. If one or more sheets have undergone successful fixation, the required power is power actually required by the fixing section. Consequently, values T1 to T4 can be calculated before the control in FIG. 4 is performed. Thus, the sheet feeding adjusting section 201 can calculate Td when setting the sheet feeding timing for the succeeding sheet in S505.

Furthermore, a method for identifying the sheet 6 is implemented by saving information indicating which of the processes in S502, S503, and S505 has set the sheet feeding timing, in RAM for each sheet, and referencing a method for setting the sheet feeding timing for the succeeding sheet 7.

As described above, according to Embodiment 1, even when the option unit switches from the operation mode 2 with high power consumption to the operation mode 1 with low power consumption during consecutive printing, the upper limit power that can be supplied to the fixing section and the sheet interval are set in accordance with the mode switching. Thus, an image-forming apparatus can be provided which enables productive image formation. Furthermore, the temperature of the fixing section can be restrained from overshooting when the upper limit power that can be supplied to the fixing section is changed.

Embodiment 2

In Embodiment 1, the determination for a change in the operation mode of the sheet discharging option apparatus 108 is carried out through the control performed by the sheet feeding adjusting section 201 to set the sheet feeding timing for the succeeding sheet. However, the determination for a change in the operation mode may be carried out through control other than the control allowing the sheet feeding timing to be set. Furthermore, a condition for starting the control performed by the power control section 204 to increase the upper limit power may be other than the method for setting the sheet feeding timing for each sheet.

Embodiment 2 is characterized in that, when a sheet is fed from the sheet feeding tray 100, the determination for a change in operation mode is made and in that, based on the result of the determination for sheet feeding, the determination for setting of the sheet feeding timing and switching of the upper limit power is made.

In instructing the sheet feeding section 150 to perform sheet feeding, the engine control section 140 saves the operating state of the sheet discharging option apparatus 108 in RAM (not shown in the drawings) on the engine control section 140 for each sheet. For the operating state of the sheet discharging option apparatus 108, one of the processes including the staple process, the normal discharge process, and the operation mode switching process is saved. The sheet feeding adjusting section 201 sets the sheet feeding timing for the succeeding sheet based on the operating state of the sheet discharging option apparatus 108 saved in RAM for each sheet and the indication from the controller section 141. The power control section 204 determines whether or not to start the process of increasing the upper limit power based on the operating state of the sheet discharging option apparatus 108 for a sheet having passed through the fixing section 104.

Figure 6:
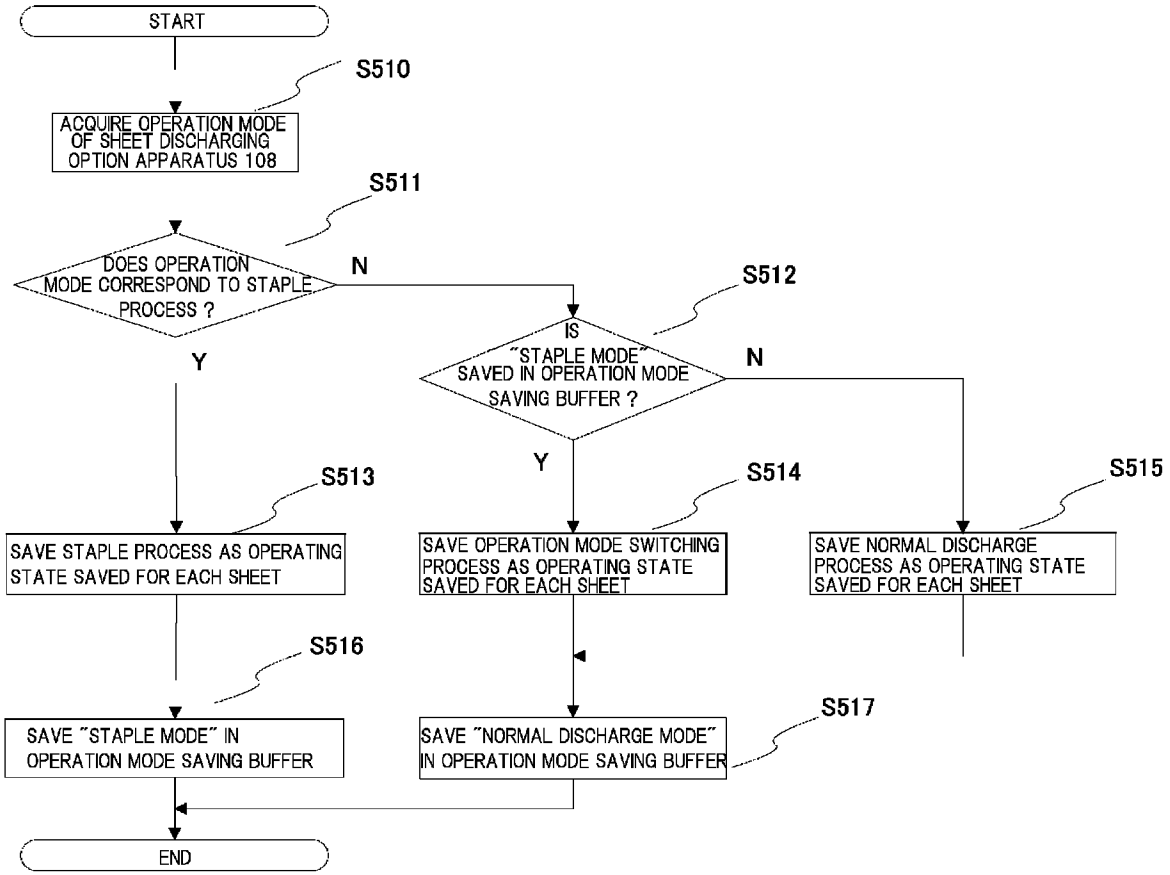
FIG. 6 is a flowchart of control according to Embodiment 2.

FIG. 6 is a flowchart of control allowing an operation of the option unit during sheet feeding to be saved.

In S510, the engine control section 140 acquires the operation mode of the sheet discharging option apparatus 108 from the acquiring section 202. In S511, the engine control section 140 determines whether or not the acquired operation mode corresponds to the staple process. Upon determining that the operation mode corresponds to the staple process, the engine control section 140 saves, in S513, the staple process in RAM as the operating state saved for each sheet. Subsequently, in S516, the engine control section 140 saves the staple mode in an operation mode saving buffer on RAM. On the other hand, upon determining, in S511, that the operation mode corresponds to the normal discharge process, the engine control section 140 executes the processing in S512. In S512, the engine control section 140 determines whether the operation mode saving buffer saved in S516 or S517 described below corresponds to the staple mode or the normal discharge mode. Upon determining that the operation mode saving buffer corresponds to the staple mode, the engine control section 140 saves, in S514, the operation mode switching process as the operating state saved for each sheet. Subsequently, in S517, the engine control section 140 saves the normal discharge mode in the operation mode saving buffer. Upon determining, in S512, that the operation mode saving buffer corresponds to the normal discharge mode, the engine control section 140 saves, in S515, the normal discharge process as the operating state saved for each sheet. The engine control section 140 subsequently executes the processing in S517.

Furthermore, when a printing operation starts, the engine control section 140 saves the normal discharge mode in the operation mode saving buffer. If the operation mode switches from the staple mode to the normal discharge process between the start of the printing operation and feeding of the first sheet, the engine control section 140 may perform an operation for normal discharge at the start of the printing operation and thus saves the normal discharge mode.

As described above, saving different values in S516 and in S517 allows a change in operation mode to be identified.

Figure 7:
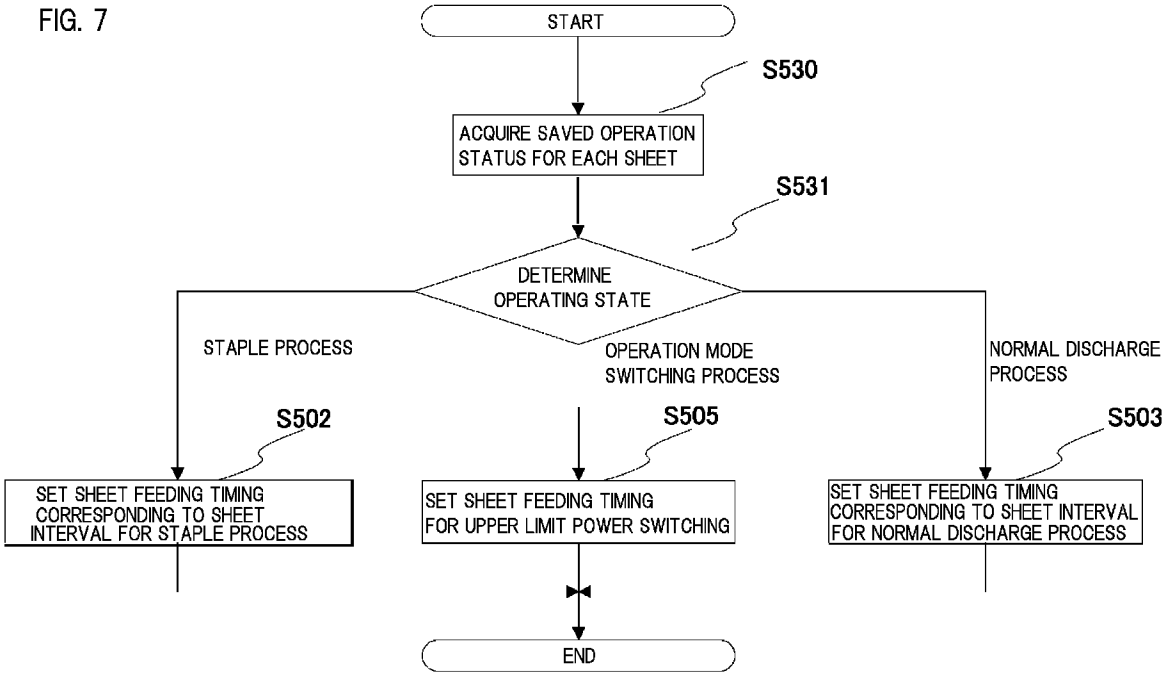
FIG. 7 is a diagram of control allowing the sheet feeding timing for the succeeding sheet to be determined according to Embodiment 2.
Figure 8:
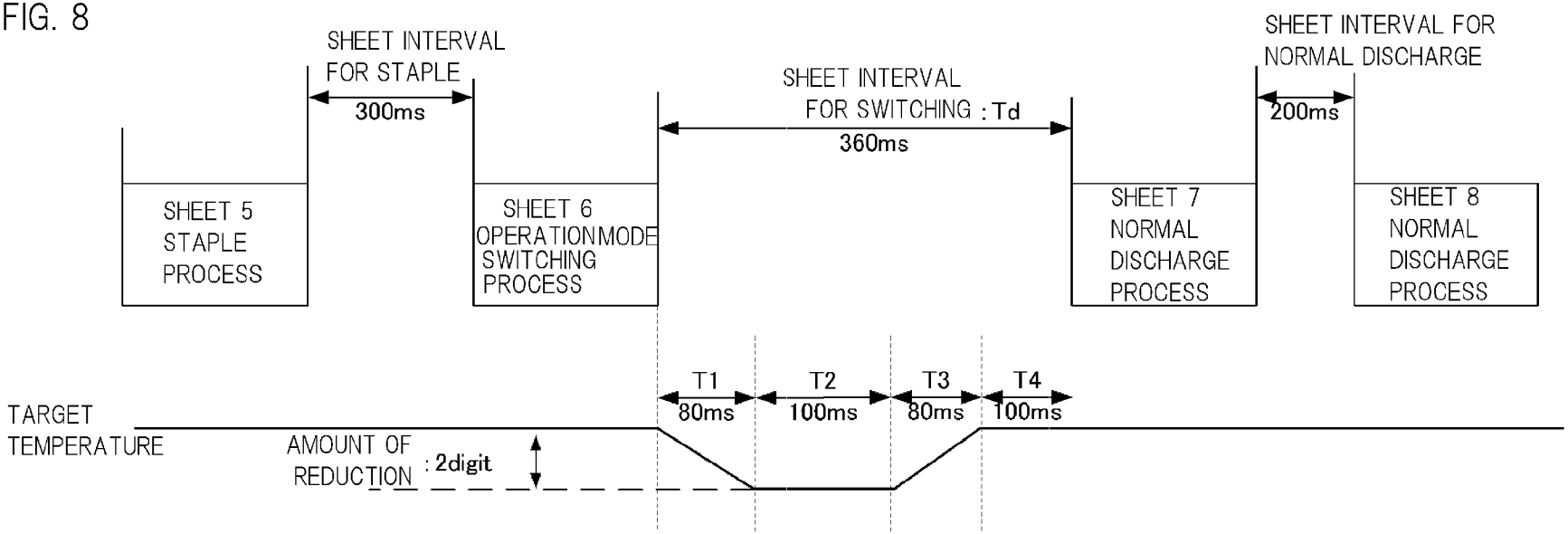
FIG. 8 is a time chart showing the control of the fixing section and the sheet interval according to Embodiment 2.

The specific contents of processing executed by the sheet feeding adjusting section 201 during consecutive printing will be described with reference to FIG. 7 and FIG. 8. FIG. 7 is a flowchart for determination of the sheet feeding timing for the succeeding sheet. FIG. 8 is a timing chart showing how the sheet interval is changed when processing described below is executed.

In S530, the sheet feeding adjusting section 201 acquires the operating state of the preceding sheet saved in RAM. In S531, on the basis of the operating state of the preceding sheet saved in RAM, the sheet feeding adjusting section 201 determines which of the processes in S502, S505, and S503 is to be executed in order to set the sheet feeding timing for the succeeding sheet. In S531, upon determining that the operating state saved in RAM corresponds to the staple process, the sheet feeding adjusting section 201 executes the processing in S502. When the operating state saved in RAM corresponds to the operation mode switching process, the sheet feeding adjusting section 201 executes the processing in S505. When the operating state saved in RAM corresponds to the normal discharge process, the sheet feeding adjusting section 201 executes the processing in S503.

Upon increasing the upper limit power, the specific contents of processing executed by the power control section 204 are similar to the specific contents of processing executed by the power control section 204 in Embodiment 1 and will thus not be described. However, the condition for starting the process of increasing the upper limit power is based on the operating state saved in RAM for the sheet having passed through the fixing section 104. When the operating state saved in RAM corresponds to the operation mode switching process, the power control section 204 starts the process of increasing the upper limit power.

According to Embodiment 2, the determination for a change in the operation mode of the sheet discharging option apparatus 108 is made during sheet feeding. Thus, the upper limit power can be increased to set an earlier sheet feeding timing without interrupting the consecutive printing operations. This enables efficient sheet feeding and fixation, allowing productivity to be improved.

Embodiment 3

In Embodiment 1, the amount of reduction in target temperature for an increase in upper limit power is calculated based on the power required to fix an image to the sheet and the upper limit power in each operation mode of the sheet discharging option apparatus 108. However, if the following are known: a lower limit value for the amount of current at which the image-forming apparatus 110 is operable, an upper limit value for the target temperature for fixation of an image to the sheet, and the upper limit power in each operation mode, the maximum value of the insufficient supply power present when the upper limit power is increased can be determined. Thus, the amount of reduction in target temperature need not be calculated for each printing operation but may have a fixed value.

Embodiment 3 is characterized in that the amount of reduction in target temperature for an increase in upper limit power has a fixed value.

The power control section 204 executes a process of increasing the upper limit power at a timing when the target sheet for the start of an increase in supplied power has passed through the fixing section 104. A method for controlling the sheet feeding adjusting section 201 is similar to the method for controlling the sheet feeding adjusting section 201 according to the above-described embodiments and will thus not be described.

Figure 9:
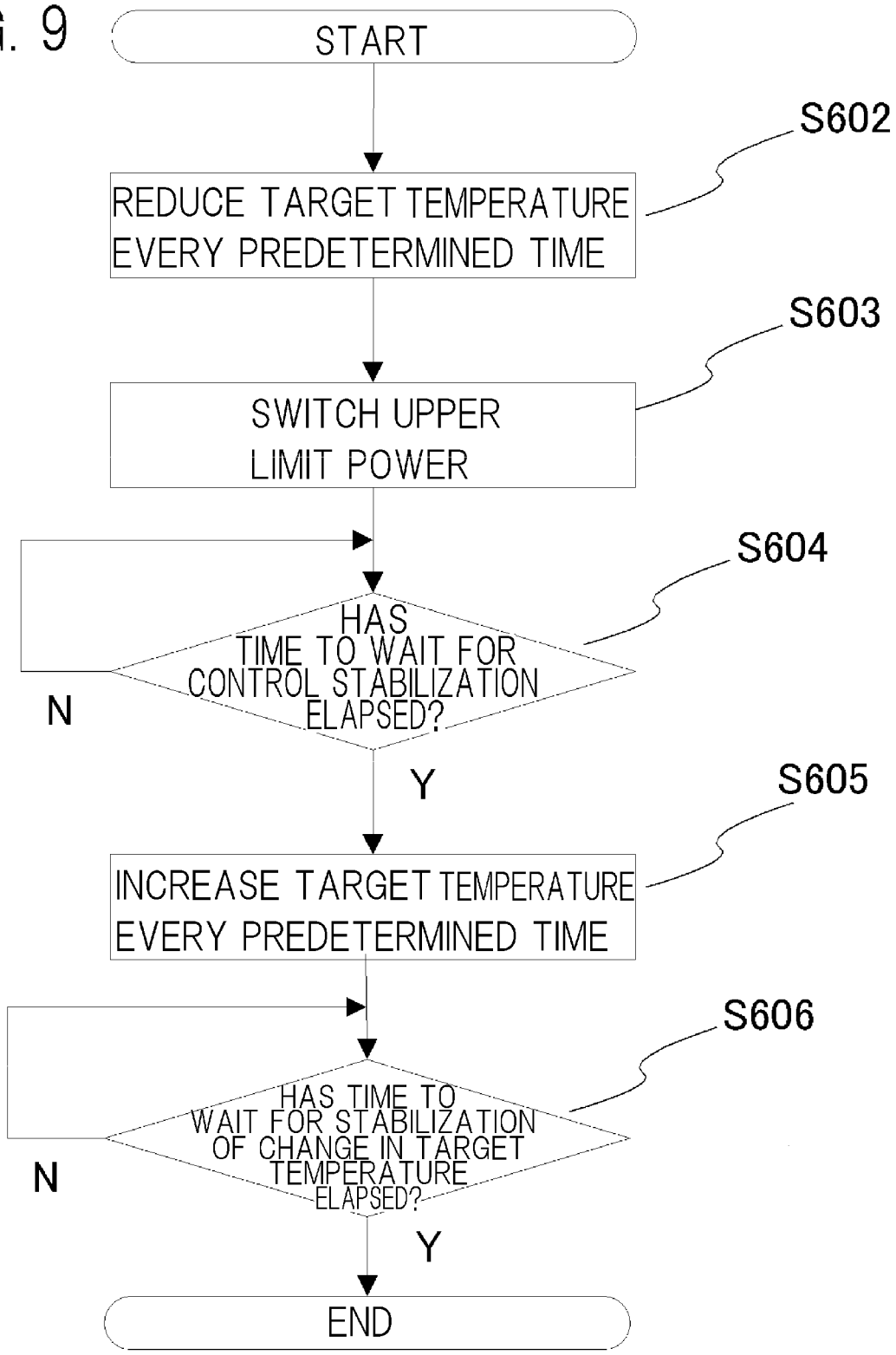
FIG. 9 is a flowchart of control according to Embodiment 3.

FIG. 9 is a flowchart for fixation control for an increase in upper limit power. The processing in S602 is executed at the timing when the target sheet for an increase in upper limit power has passed through the fixing section 104. In S602, the power control section 204 lowers the target temperature in 80 msec by reducing the target temperature by 1° C. every 40 msec. In S603, the power control section 204 increases the upper limit power. In S604, the power control section 204 waits 100 msec until a transient state resulting from the increase in supplied power ends and the control is stabilized. In S605, the power control section 204 raises the target temperature lowered in S602 in 80 msec by increasing the target temperature by 1° C. every 40 msec. In S606, the power control section 204 waits 100 msec until a transient state resulting from the switching of the target temperature ends and the control is stabilized.

According to Embodiment 3, even in a configuration in which the required power calculating section 205 does not calculate the amount of reduction in target temperature, the upper limit power can be increased during a printing operation with satisfactory fixing performance exhibited. Therefore, Embodiment 3 enables efficient sheet feeding and fixation, allowing productivity to be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-187461, filed Sep. 10, 2013, which is hereby incorporated by reference herein in its entirety.

What is claimed is:

1. An image-forming apparatus comprising:

a fixing section that fixes an image formed on a recording material to the recording material;

a timing setting section that sets a timing at which the recording material is fed;

an operation mode acquiring section that acquires an operation mode of an option unit installed in the image-forming apparatus; and a power control section that sets an upper limit of power that can be supplied to the fixing section in accordance with the operation mode acquired by the acquiring section, the power control section controlling power supplied to the fixing section within a range of the upper limit power, wherein, when the operation mode acquired by the operation mode acquiring section changes from a second operation mode in which the option unit consumes a large amount of current to a first operation mode in which the option unit consumes a small amount of current, while images are being consecutively formed on a plurality of recording materials;

the power control section increases the upper limit of power to be higher than that in the second operation mode, and the timing setting section sets a feeding interval in the first operation mode, at which the recording materials are consecutively fed, narrower than that in the second operation mode.

2. The image-forming apparatus according to claim 1, wherein, when the operation mode acquired by the operation mode acquiring section changes from the second operation mode to the first operation mode while the images are being consecutively formed on the plurality of recording materials, the power control section lowers a target temperature of the fixing section before increasing the upper limit power.

3. The image-forming apparatus according to claim 2, wherein, when the operation mode acquired by the operation mode acquiring section changes from the second operation mode to the first operation mode while the images are being consecutively formed on the plurality of recording materials, the timing setting section sets a feeding interval, at which the recording materials are consecutively fed, wider than that in the second operation mode before setting a feeding interval narrower than that in the second operation mode.

4. The image-forming apparatus according to claim 2, wherein, when the operation mode acquired by the operation mode acquiring section changes from the second operation mode to the first operation mode while the images are being consecutively formed on the plurality of recording materials, the power control section executes a fixation process by lowering the target temperature before increasing the upper limit power and then bringing the target temperature back to an original temperature.

5. The image-forming apparatus according to claim 1, wherein the option unit is a sheet discharging option unit that executes at least one of a sorting process of the recording materials and a staple process of the recording materials.

6. The image-forming apparatus according to claim 5, wherein the first operation mode is such that the recording material is discharged without executing either the sorting process or the staple process, and the second operation mode is such that the sheet discharging option unit executes at least one of the sorting process and the staple process.

7. An image-forming apparatus comprising:

a fixing section that fixes an image formed on one of a plurality of recording materials to the recording material;

a sheet discharging unit that executes at least one of a sorting process of the recording materials and a staple process of the recording materials;

a timing setting section that sets a timing at which the recording material is fed;

an operation mode acquiring section that acquires an operation mode of the sheet discharging unit; and a power control section that sets an upper limit of power that can be supplied to the fixing section in accordance with the operation mode acquired by the acquiring section, the power control section controlling power supplied to the fixing section within a range of the upper limit of power, wherein, when the operation mode acquired by the operation mode acquiring section changes from a second operation mode in which the option unit consumes a large amount of current to a first operation mode in which the sheet discharging unit consumes a small amount of current, while images are being consecutively formed on a plurality of recording materials, the power control section increases the upper limit of power to be higher than that in the second operation mode, and the timing setting section sets a feeding interval in the first operation mode, at which recording materials are consecutively fed, narrower than that in the second operation mode.

8. The image-forming apparatus according to claim 7, wherein the first operation mode is such that the recording material is discharged without executing either the sorting process or the staple process, and the second operation mode is such that the sheet discharging option unit executes at least one of the sorting process and the staple process.

9. The image-forming apparatus according to claim 7, wherein, when the operation mode acquired by the operation mode acquiring section changes from the second operation mode to the first operation mode while the images are being consecutively formed on the plurality of recording materials, the power control section lowers a target temperature of the fixing section before increasing the upper limit power.

10. The image-forming apparatus according to claim 9, wherein, when the operation mode acquired by the operation mode acquiring section changes from the second operation mode to the first operation mode while the images are being consecutively formed on the plurality of recording materials, the timing setting section sets a feeding interval, at which the recording materials are consecutively fed, wider than that in the second operation mode before setting a feeding interval narrower than that in the second operation mode.

11. The image-forming apparatus according to claim 9, wherein, when the operation mode acquired by the operation mode acquiring section changes from the second operation mode to the first operation mode while the images are being consecutively formed on the plurality of recording materials, the power control section executes a fixation process by lowering the target temperature before increasing the upper limit power and then bringing the target temperature back to an original temperature.

* * * * *